US009565923B2

(12) United States Patent
Leask

(10) Patent No.: US 9,565,923 B2
(45) Date of Patent: Feb. 14, 2017

(54) WATER BOTTLE

(71) Applicant: Talin Leask, La Crescenta, CA (US)

(72) Inventor: Talin Leask, La Crescenta, CA (US)

( * ) Notice: Subject to any disclaimer, the term of this patent is extended or adjusted under 35 U.S.C. 154(b) by 6 days.

(21) Appl. No.: 14/625,295

(22) Filed: Feb. 18, 2015

(65) Prior Publication Data

US 2016/0235187 A1 Aug. 18, 2016

(51) Int. Cl.

| | |
|---|---|
| ***B67D 7/84*** | (2010.01) |
| ***A45F 3/18*** | (2006.01) |
| ***B65D 1/02*** | (2006.01) |
| ***B65D 25/42*** | (2006.01) |
| ***B65D 43/02*** | (2006.01) |

(52) U.S. Cl.

CPC ..... *A45F 3/18* (2013.01); *B65D 1/0207* (2013.01); *B65D 1/0223* (2013.01); *B65D 25/42* (2013.01); *B65D 43/02* (2013.01)

(58) Field of Classification Search

CPC ..... A45F 2/20; A45F 2/18; A45F 3/20; A45F 3/18; B65D 1/0207; B65D 1/02; B65D 1/0223; B65D 25/42; B65D 43/02

USPC ..... 222/175, 92, 106, 107; 220/703–710; 215/387–389

IPC ..... B65D 1/0207, 1/02, 1/0223, 25/42, B65D 43/02

See application file for complete search history.

(56) References Cited

U.S. PATENT DOCUMENTS

| | | | |
|---|---|---|---|
| 2,229,403 | A | 1/1941 | Benander |
| D247,026 | S | 1/1978 | Sterniske |
| 4,191,302 | A | 3/1980 | Fiducia |
| D256,581 | S | 8/1980 | Bartin |
| D277,075 | S | 1/1985 | Blais et al. |
| D279,250 | S | 6/1985 | Holloway |
| D307,961 | S | 5/1990 | Howell |
| D308,802 | S | 6/1990 | Ward |
| D332,802 | S | 1/1993 | Greenhut et al. |
| 5,402,899 | A | 4/1995 | Ammeson |
| D360,558 | S | 7/1995 | Appleman |
| D375,222 | S | 11/1996 | Bonaddio et al. |
| D399,641 | S | 10/1998 | Meador |
| D418,773 | S | 1/2000 | Saito |
| D458,799 | S | 6/2002 | Andujar |
| D463,288 | S | 9/2002 | Payer |
| D487,862 | S | 3/2004 | Tincher |
| D503,870 | S | 4/2005 | Marks et al. |
| D530,210 | S | 10/2006 | Chisholm |
| D567,886 | S | 4/2008 | Lampert et al. |
| D574,295 | S | 8/2008 | Everett |

(Continued)

FOREIGN PATENT DOCUMENTS

| | | | | |
|---|---|---|---|---|
| CA | 2427438 | A1 * | 11/2004 | ..... A45F 3/20 |
| CN | 203563837 | | 4/2014 | |

(Continued)

OTHER PUBLICATIONS

Chinese Office Action and English translation dated Jun. 12, 2016, for corresponding Chinese Application No. 201620127636.7, filed Feb. 18, 2016.

(Continued)

*Primary Examiner* — Lien Ngo

(74) *Attorney, Agent, or Firm* — David D. Brush; Westman Champlin & Koehler, P.A.

(57) ABSTRACT

Fluid carrying apparatus having an outer helical tubular casing which, in use, holds fluid, and an inner helical tubular member within the outer helical tubular casing through which the fluid can be delivered from the outer helical tubular casing.

13 Claims, 4 Drawing Sheets

(56) References Cited

U.S. PATENT DOCUMENTS

| | | | | |
|---|---|---|---|---|
| D595,589 | S | 7/2009 | Pizzorni | |
| 7,665,156 | B1 * | 2/2010 | Hewitt | A41D 13/0518 2/455 |
| D649,709 | S | 11/2011 | Loman | |
| D660,078 | S | 5/2012 | Kehoe | |
| D680,463 | S | 4/2013 | Luoni | |
| D698,658 | S * | 2/2014 | Leask | D9/435 |
| 2009/0134184 | A1 * | 5/2009 | Stollmann | A44C 5/003 222/78 |
| 2013/0284762 | A1 * | 10/2013 | Voss | A42B 1/006 222/175 |
| 2015/0289690 | A1 * | 10/2015 | Parker | A45F 3/16 220/560 |

FOREIGN PATENT DOCUMENTS

| | | | | |
|---|---|---|---|---|
| GB | 4023216 | | 1/2012 | |
| GB | 2515269 | A | 12/2014 | |
| WO | WO 01/02257 | A1 * | 1/2001 | A45F 3/20 |

OTHER PUBLICATIONS

Second Chinese Office Action and English translation dated Sep. 18, 2016, for corresponding Chinese Application No. 201620127636.7, filed Feb. 18, 2016.

* cited by examiner

WATER BOTTLE

FIELD OF THE DISCLOSURE

The present disclosure relates to a water bottle.

BACKGROUND OF THE DISCLOSURE

Many people who take part in physical activities such as, for example, running or cycling have a need to carry liquid on their person, usually held in a portable water bottle.

Carrying the water bottles, particularly whilst running, is a common problem. Holding the bottle or a handle of the bottle in a clenched hand is not preferable as this quickly becomes uncomfortable and can interrupt the running style and rhythm of the user.

Many runners carry a belt of some kind on which the water bottle can be clipped, or carry a backpack to hold the bottle. These methods too can become uncomfortable and disruptive, particularly when movement causes the bottle to repeatedly knock against side of the wearer.

SUMMARY

According to a first aspect of the disclosure there is provided fluid carrying apparatus having an outer helical tubular casing which, in use, holds fluid, and an inner helical tubular member within the outer structure through which the fluid can be delivered from the outer structure.

In an exemplary embodiment, one end of the outer structure comprises an outlet nozzle connected to the inner tubular member.

In an exemplary embodiment, the apparatus further comprises a cap or lid that is locatable over the outlet.

In an exemplary embodiment, the apparatus further comprises a closed end piece connectable to the end of the outer casing opposite to the end having the outlet.

In an exemplary embodiment, the outer casing is made from a flexible plastics material.

In an exemplary embodiment, at least part of the surface of the outer casing is formed from a frictionless material. Alternatively said at least part of the casing includes a strip of frictionless material located on said part.

In an exemplary embodiment, said part of the outer casing forms the inside surface of the apparatus that rests against a limb of a wearer in use.

In an exemplary embodiment, said part of the outer casing is formed as a flattened section.

BRIEF DESCRIPTION OF THE DRAWINGS

One embodiment of the disclosure will now be described by way of example only, with reference to the accompanying figures in which.

DETAILED DESCRIPTION OF ILLUSTRATIVE EMBODIMENTS

An illustrative embodiment of the present disclosure provides a water bottle, the shape and design of which allows it to be located around a limb the wearer without the need for it to be handheld or the need for any separate fixing means.

Figure 1:
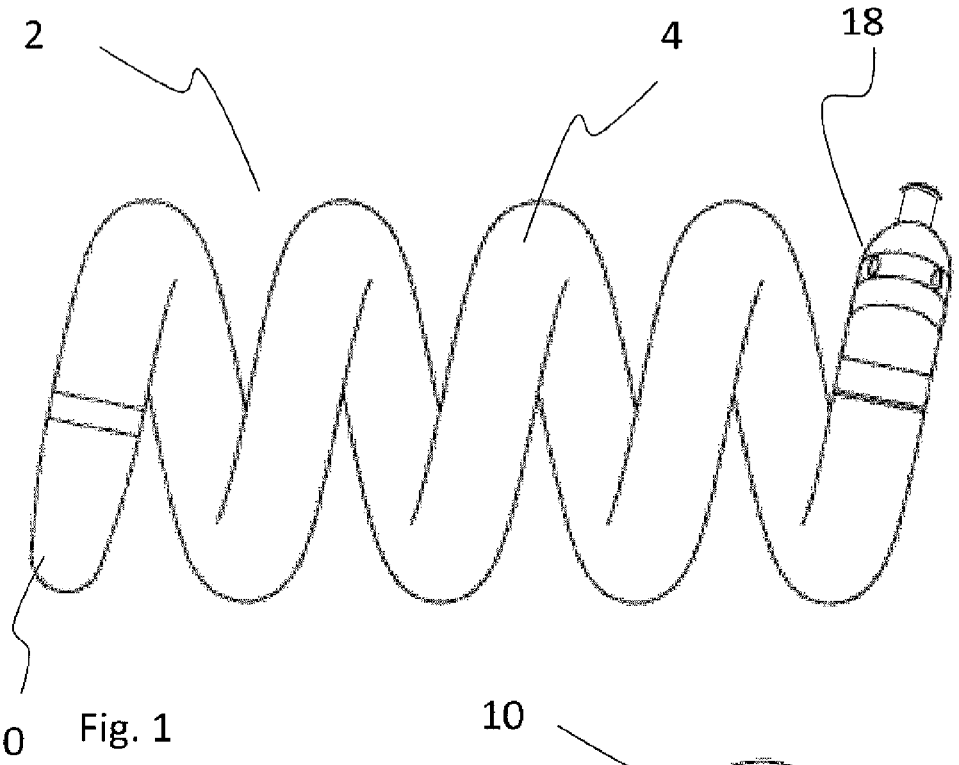
FIG. 1 is a side view of a water bottle constructed in accordance with the present disclosure.
Figure 2:
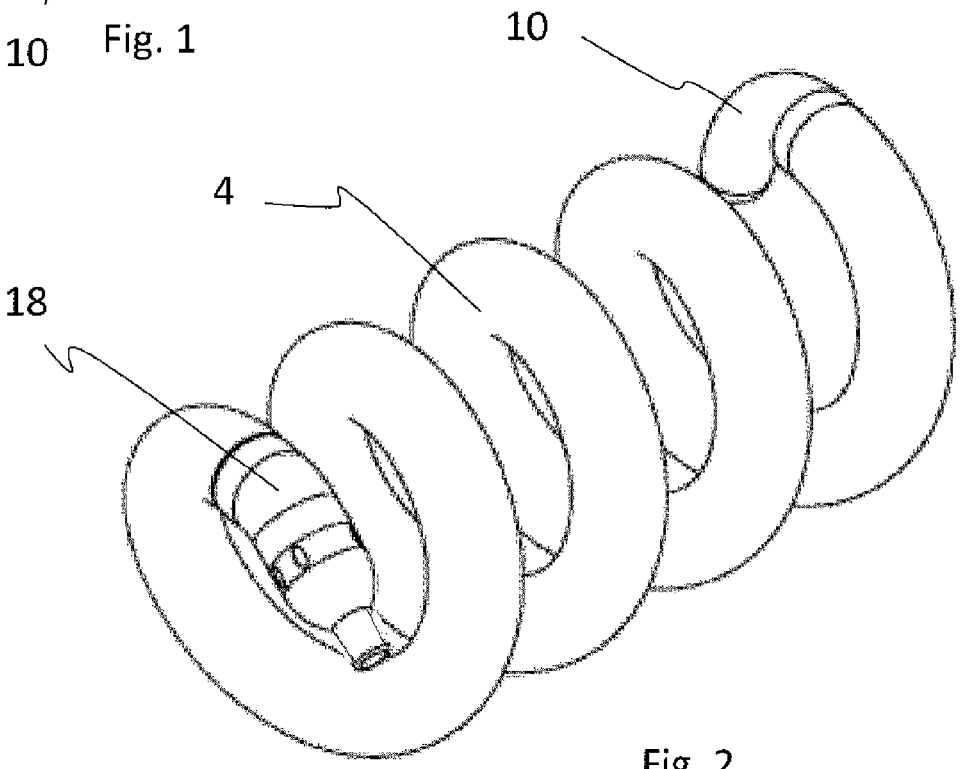
FIG. 2 is perspective view of the water bottle of FIG. 1.

Referring first to FIG. 1, a water bottle 2 constructed in accordance with an exemplary embodiment of the disclosure comprises a tubular outer casing 4 that is helical in shape. The casing 4 is made from a flexible plastics material which has sufficient elastic memory to retain its helical shape. The shape of the bottle 2 is such that it can be located over and around an arm of the user so that it does not require the user to hold the bottle 2 in a hand. The coils of the helical structure are flexible allowing them to widen to be fitted over the arm. The elastic memory of the material then causes the coils to contract around arm. The material is sufficiently flexible such that the coils will only contract to fit around the arm and will not continue to contract to cause discomfort.

In an exemplary embodiment, the helical structure has an inner diameter defined by the inner surfaces of the coils, which is sized to fit the forearm and/or upper arm of a typical adult male and/or female person.

The material may have insulative properties to prevent any fluid within the casing from heating up through heat generated by the body of the wearer or through the ambient outside temperature, thereby retaining the fluid at a suitable drinkable and refreshing temperature.

Figure 3:
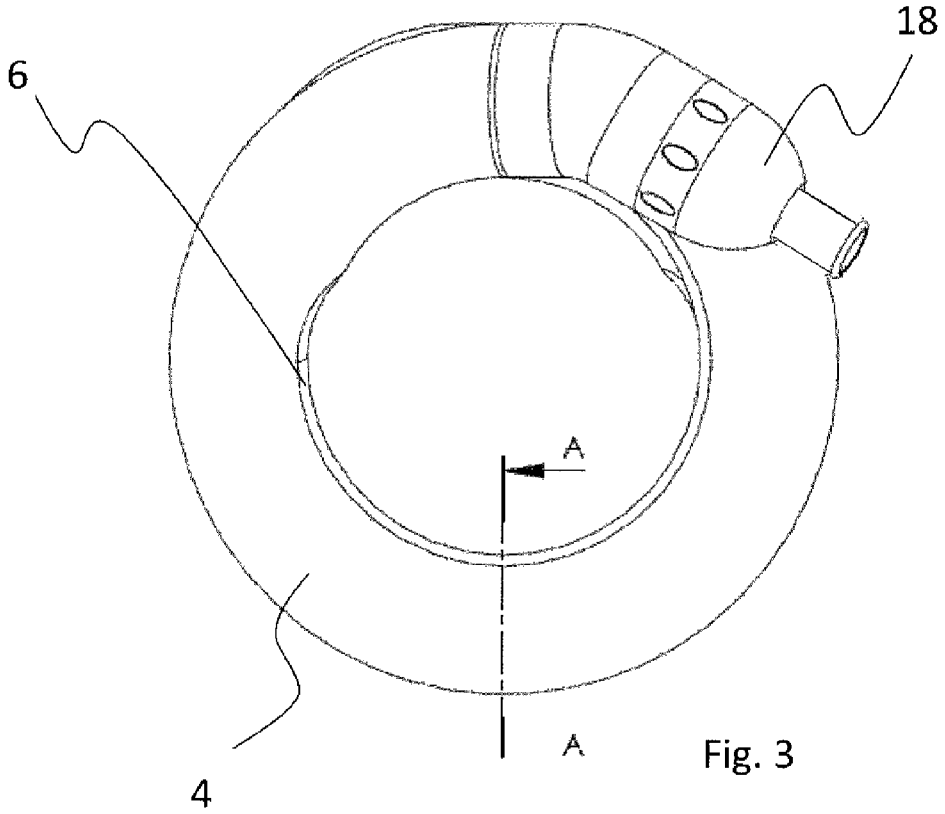
FIG. 3 is an end view of the water bottle.
Figure 4:
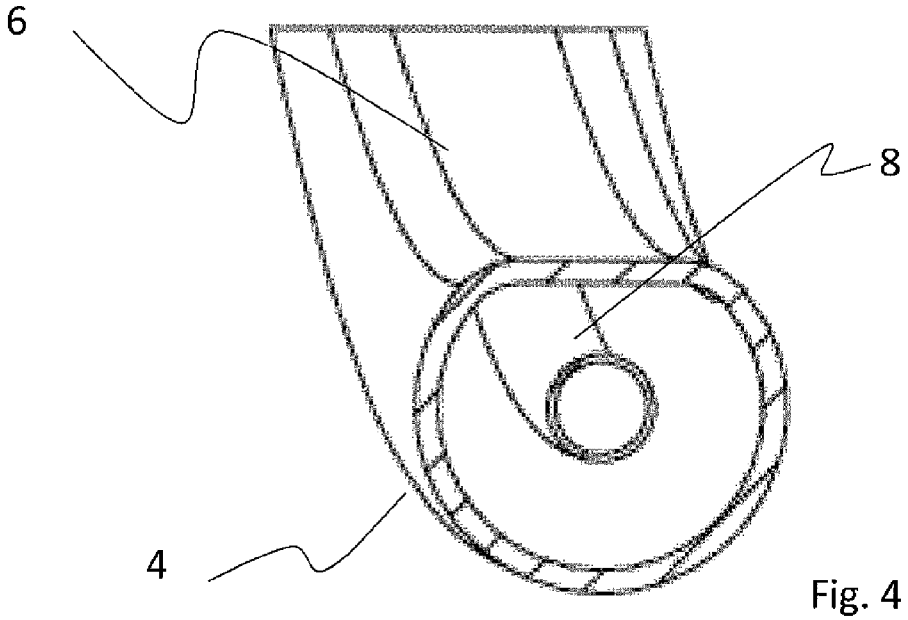
FIG. 4 is a cross-section of the water bottle taken through A-A of FIG. 3.

As can be seen most clearly from FIGS. 3 and 4, the outer casing 4 has a flattened section 6 extending along the length, or at least part of the length of the casing 4. In use the flattened section 6 forms the inner surface of the casing 4 that lies against the arm of the wearer. This provides additional comfort to the wearer.

The flattened section 6 is formed from a smooth frictionless material to prevent the casing 4 rubbing against the arm of the wearer during movement. The entire casing 4 may be made of the suitable frictionless material or alternatively only the material of the flattened section 6 is frictionless. Alternatively still, a separate layer of frictionless material may be applied to the casing 4 along the flattened section 6.

Figure 5:
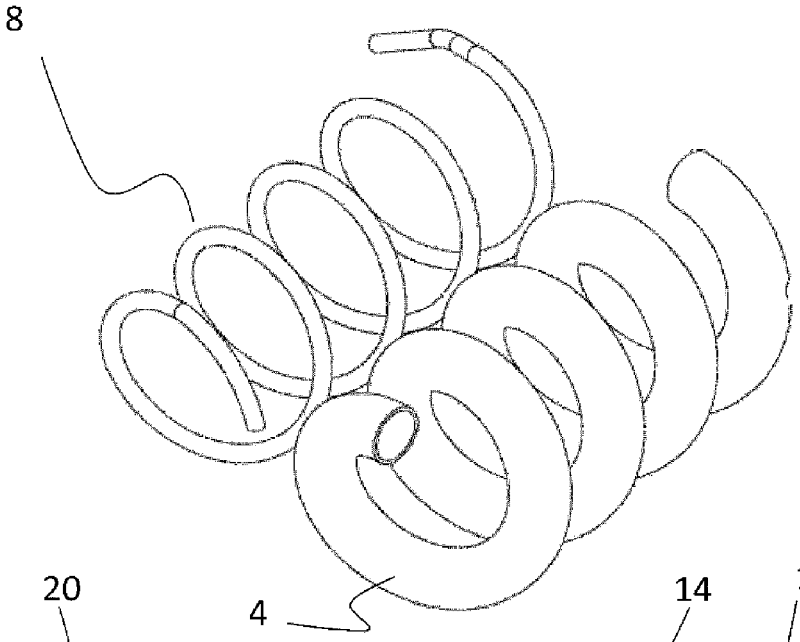
FIG. 5 is a perspective deconstructed view of the water bottle apparatus showing the inner and outer casing.

Referring now to FIGS. 4 and 5, the apparatus further comprises an inner tube 8 located within the outer casing 4. The inner tube 8 is also helical and follows the profile of the outer casing 4. The inner tube 8 provides a method of delivering fluid within the casing 4 to the user. The use of an inner tube 8 (as opposed to a simple opening in the end of the casing 4 to provide access to the fluid) provides sufficient pressure within the apparatus for the fluid to be readily delivered to the user with little effort. This is very important whilst the wearer is exercising as their balance and running stride will remain unaffected whilst the fluid is being consumed.

The inner tube 8 may sit freely within the outer casing 4 or may alternatively be held in position within and along the casing 4 via, for example, inner radial spokes (not shown) or similar means.

Figure 7:
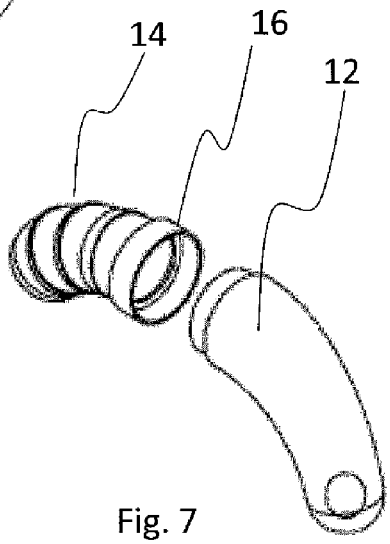
FIG. 7 is an exploded view of the end section of the water bottle.

One end of the casing 4 includes an end section 10 (see FIG. 7 which includes a closed end piece 12 connected to a tubular connector 14 which fits into the end of the casing 4. The tubular connector 14 includes radial flanges 16 which abut against the inner wall of the casing 4 to provide grip and prevent accidental removal. The end piece 12 is clipped into the tubular connector 14 and can be unclipped from it to empty the casing 4 when required.

Figure 6:
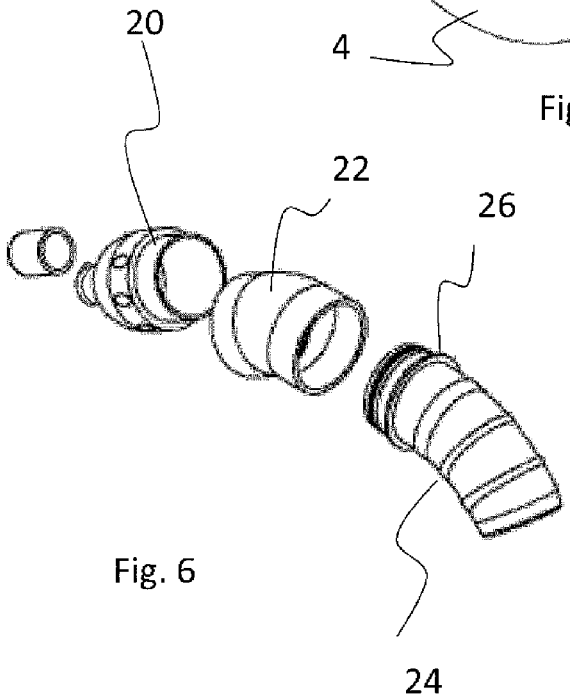
FIG. 6 is an exploded view of the outlet valve of the water bottle.

The other end of the casing 4, remote from the closed end section 10 is shown in FIG. 6 and includes a removable outlet section 18. The section 18 includes an outlet end 20 connected via an intermediary section 22 to a tubular connector 24. The tubular connector 24 also has radial flanges 26 to abut against the inner wall of the casing 4 to secure the outlet 16 to the end of the casing 4.

One end of the inner tube 8 is removably secured to the outlet end 20 such that fluid within the casing 4 can be sucked through the tube 8 and out through the outlet section 18 into the mouth of the user. In an exemplary embodiment, the inner tube 8 extends from outlet end 20 to an end section 10. The inner tube 8 may have an open end at end section 10 to permit fluid contained within bottle 2 to be drawn into the open end, through the inner tube and out the outlet end 20.

The outlet end 20 is removable from the intermediary section 22 to allow access to the inside of the casing 4 to allow the casing to be filled with fluid. In one example, the outlet end 20 includes a push/pull nozzle, which closes/opens a valve for storage and use, respectively. The nozzle is attached to the end of inner tube 8 that is adjacent outlet end 20, such as by a friction fit. Other types of nozzles can also be used.

Figure 8:
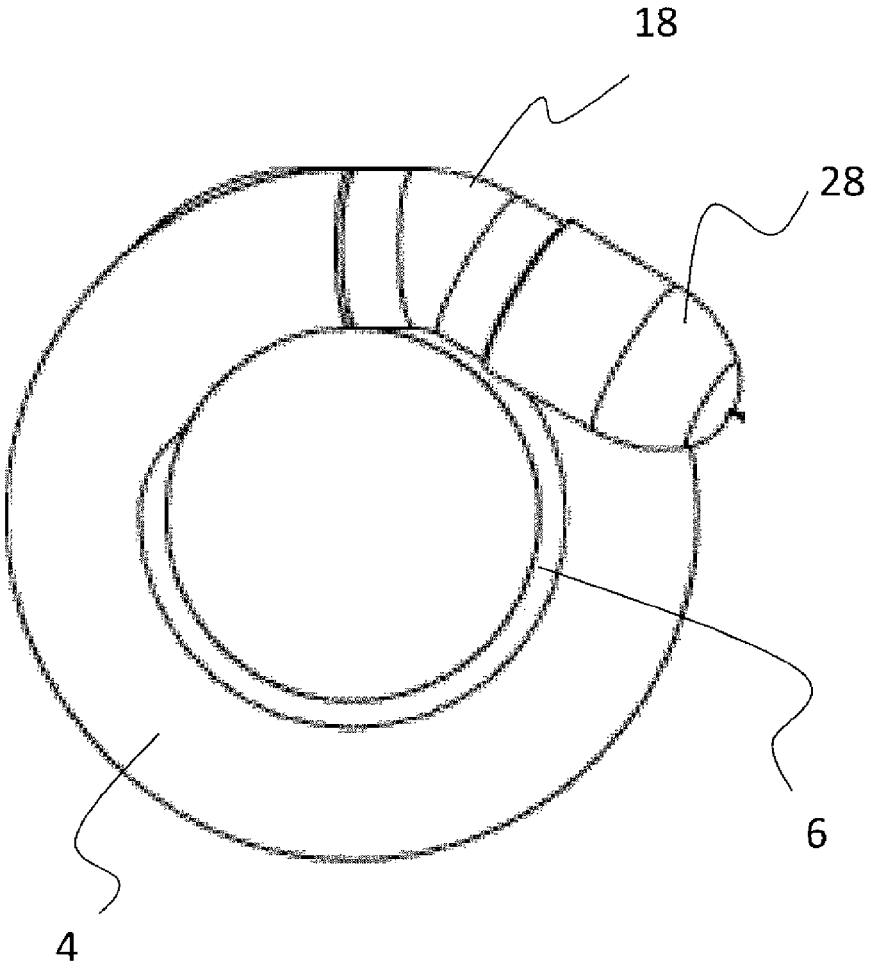
FIG. 8 is an end view of the water bottle including a cap.

A cap or lid 28 can be located over the outlet 20 (e.g., over the nozzle) when fluid is not required, as can be seen in FIG. 8.

Although the present disclosure has been described with reference to one or more examples, workers skilled in the art will recognize that changes may be made in form and detail without departing from the scope of the disclosure and/or the appended claims.

What is claimed is:

1. A fluid carrying apparatus comprising:

an outer helical tubular casing configured to hold a fluid and having first and second ends;

an inner helical tubular member within the outer helical tubular casing through which the fluid can be delivered from the outer helical tubular casing:

an intermediary tubular section having a curved longitudinal cross section; and an outlet end, which is removably connected to the first end of the outer helical tubular casing via the intermediary tubular section, wherein the outlet end comprises an outlet nozzle connected to the inner helical tubular member.

2. The fluid carrying apparatus according to claim 1, wherein apparatus further comprises a cap or lid that is locatable over the outlet nozzle.

3. The fluid carrying apparatus according to claim 1, wherein the apparatus further comprises a closed end piece connectable to the second end of the outer helical tubular casing opposite to the first end having the outlet nozzle.

4. The fluid carrying apparatus according to claim 1, wherein the outer helical tubular casing is made from a flexible plastic material.

5. The fluid carrying apparatus according to claim 1, wherein at least part of an outer surface of the outer helical tubular casing is formed from a frictionless material.

6. The fluid carrying apparatus according to claim 5, wherein said part of the outer surface forms an inside surface of the outer helical tubular casing, which is configured to rest against a limb of a wearer in use.

7. The fluid carrying apparatus according to claim 1, wherein at least part of the outer helical tubular casing includes a strip of frictionless material located on said part.

8. The fluid carrying apparatus according to claim 7, wherein said part of the outer helical tubular casing forms an inside surface of the outer helical tubular casing, which is configured to rest against a limb of a wearer in use.

9. The fluid carrying apparatus according to claim 1, wherein the outer helical tubular casing comprises an inner diameter surface, which is formed as a flattened section.

10. The fluid carrying apparatus according to claim 9, wherein the outer helical tubular section comprises a circular cross-section, except at the flattened section along the inner diameter surface.

11. The carrying apparatus according to claim 1, wherein the outlet end is removable from the intermediary section to permit the outer helical tubular casing to be filled with a fluid.

12. A fluid carrying apparatus comprising:

an outer helical tubular casing configured to hold a fluid and having first and second ends, wherein the outer helical tubular casing comprises an inner diameter surface, which is formed as a flattened section, and a circular cross-section, except at the flattened section along the inner diameter surface;

an inner helical tubular member within the outer helical tubular casing through which the fluid can be delivered from the outer helical tubular casing;

an intermediary tubular section having a curved longitudinal cross section;

an outlet end, which is removably connected to the first end of the outer helical tubular casing via the intermediary tubular section, wherein the outlet end comprises an outlet nozzle connected to the inner helical tubular member; and a tubular connector coupled between the intermediary tubular section and the outer helical tubular casing, the tubular connector comprising at least one radial flange that abuts an inner wall of the outer helical tubular casing to secure the outlet end to the outer helical tubular casing.

13. The carrying apparatus according to claim 12, wherein the outlet end is removable from the intermediary section to permit the outer helical tubular casing to be filled with a fluid.

* * * * *